US005599050A

United States Patent [19]

Tinsley

[11] Patent Number: 5,599,050

[45] Date of Patent: Feb. 4, 1997

[54] LID-LOCKING DEVICE FOR TRASH CONTAINERS

[76] Inventor: Harry Tinsley, 65 Potter Dr., Belleville, Mich. 48111

[21] Appl. No.: 534,737

[22] Filed: Sep. 27, 1995

[51] Int. Cl.[6] ..... E05C 3/02

[52] U.S. Cl. ..... 292/230; 292/210; 220/908

[58] Field of Search ..... 292/230, 231, 292/210, DIG. 22; 220/315, 908

[56] References Cited

U.S. PATENT DOCUMENTS

| | | | |
|---|---|---|---|
| 4,155,584 | 5/1979 | Pracchia | 294/68.26 |
| 4,182,530 | 1/1980 | Hodge | 294/68.26 |
| 5,088,616 | 2/1992 | Susko et al. | 220/343 |
| 5,094,358 | 3/1992 | Serio, Sr. | 220/315 |
| 5,094,487 | 3/1992 | Drewry | 292/237 |
| 5,118,000 | 6/1992 | Howell et al. | 220/908 |
| 5,419,598 | 5/1995 | Kreitzer | 292/230 |
| 5,474,341 | 12/1995 | Putman et al. | 292/230 |

*Primary Examiner*—Rodney M. Lindsey
*Attorney, Agent, or Firm*—James M. Deimen

[57] ABSTRACT

A gravity activated lid-locking device for trash containers comprises a mechanism enclosed in a security box attached to the front of the trash container. Extending from the security box is a rotatable through shaft having a bar thereattached, the bar extending over one or more lids on the trash container. The mechanism includes a gravity lock comprising a short steel bar free to rotate on an internal shaft and a turn stop also comprising a steel bar welded to a shaft that passes through the box. The gravity stop hangs vertically within the box and prevents the turn stop and its shaft from rotating when the trash container is right side up. When the trash container is rotated to empty, the gravity lock rotates, freeing the turn stop to rotate and thereby allowing the through shaft and bar to tilt backwards and release the lid. Extending through the box is a second shaft having a small steel tab thereattached within the box. Upon rotation of the second shaft the small steel tab moves aside the gravity lock thereby overriding the lock and allowing the bar to be manually tilted back so that the lids can be opened with the trash container right side up. Externally attached to the second shaft are means for manually locking the second shaft to prevent the override from being activated.

17 Claims, 3 Drawing Sheets

LID-LOCKING DEVICE FOR TRASH CONTAINERS

BACKGROUND OF THE INVENTION

The field of the invention pertains to commercial and industrial trash containers and, in particular, to trash containers that can be lifted up and substantially rotated upside down by a hydraulic mechanism at the front of a trash carrier truck to thereby unload the trash into the truck. The modern truck mounted mechanisms permit the operator of the truck to empty the container into the truck without leaving the truck cab.

One continuing problem with large trash containers is the unauthorized use of the containers by persons wishing to dispose of trash without paying for the cost of disposing of the trash. This problem is becoming increasingly costly because of the increasing cost of suitable disposal sites. Moreover, many trash containers are being used for recyclable materials and therefore dedicated to specific materials such as box board or white paper. The lids are typically as shown in U.S. Pat. No. 5,088,616 and are used on a variety of sizes of trash containers that are emptied by lifting and tilting substantially upside down.

U.S. Pat. No. 4,155,584 discloses a gravity operated mechanism located within the trash container. The mechanism uses a spring urged lever to latch the lid from underneath within the trash container. In U.S. Pat. No. 4,182,530 a spring urged latch is retained by a gravity urged rotatable member. This mechanism relies upon the weight of the lid to release the latch when the trash container is tilted upside down.

A latch box is located on the side of the trash container in U.S. Pat. No. 5,094,487. This side mounted latch box includes a weighted bar that swivels into and out of position to latch and unlatch a bar depending from the lid. In U.S. Pat. No. 5,094,358 a trash container front mounted latch bar and latch box is disclosed. In one version a swivelable gravity activated bar engages an L-shaped bar attached to a rotatable shaft. In a second version a freely movable ball engages and disengages a bent bar attached to the rotatable shaft.

Trash containers are subjected to severe impacts because they are frequently banged and dropped in the unloading process. Therefore the following mechanism has been developed to provide a mechanism that will not be damaged by the typical mistreatment to which trash containers are subject.

SUMMARY OF THE INVENTION

The new lid-locking device comprises a bar tiltable over and away from one or more lids on a trash container. The bar is attached to a shaft which in turn passes through an enclosed security box containing a pendular device to lock the shaft and bar over the lids when the trash container is right side up and to automatically release the shaft and bar when the trash container is substantially upside down.

Within the security box is a gravity lock comprising a short steel bar free to rotate on an internal shaft and a turn stop also comprising a steel bar welded to the shaft that passes through the box. The gravity stop hangs vertically within the box and prevents the turn stop and its shaft from rotating when the trash container is right side up. When the trash container is turned substantially upside down, the gravity lock rotates, freeing the turn stop to rotate and thereby allowing the through shaft and bar to tilt backwards and release the lids.

Extending through the box is a second shaft having a small steel tab thereattached within the box. Upon rotation of the second shaft the small steel tab moves aside the gravity lock thereby overriding the lock and allowing the bar to be manually tilted back so that the lids can be opened with the trash container right side up. Externally attached to the second shaft are means for manually locking the second shaft to prevent the override from being activated.

DESCRIPTION OF THE PREFERRED EMBODIMENTS

Figure 1:
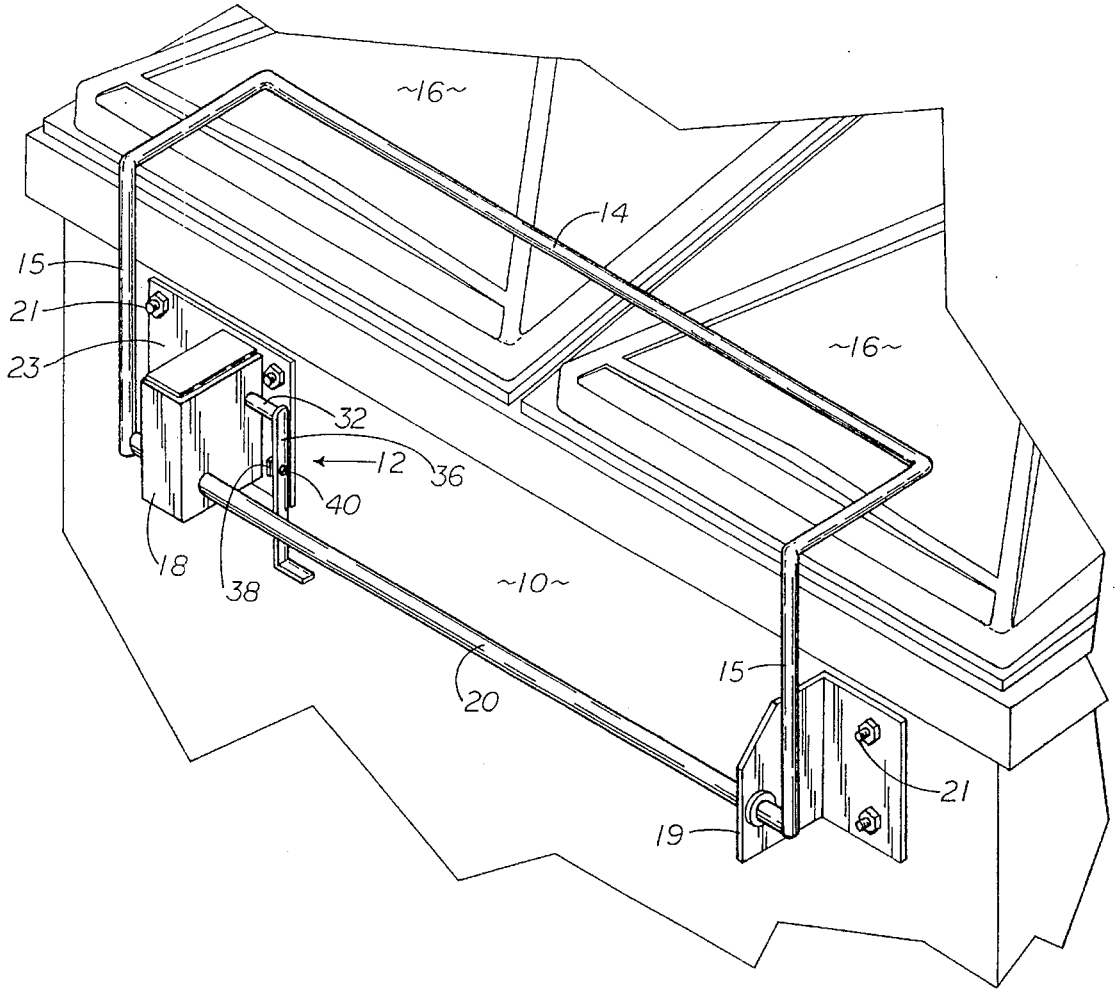
FIG. 1 is a partial perspective view of a trash container with the lid-locking device.

Illustrated in FIG. 1 is a portion of the front of a trash container 10 having an external latch mechanism generally denoted by 12 and a retention bar 14 extending over the lids 16 of the trash container. At each end the bar 14 extends over and down at 15 in front of the container 10 to a horizontal shaft 20 which passes through a box 18 containing the mechanism that controls the rotation of the shaft 20. The bar 14 is rigidly fastened such as by welding to the ends of the shaft 20.

The box 18 supports the shaft 20 adjacent one end and a bracket 19 supports the shaft 20 adjacent the other end, both the box, the backing plate 23 and the bracket being bolted 21 as shown to the front panel of the container 10. Thus, when the shaft 20 is permitted to rotate the bar 14 can tilt back over the box 18 and thereby release the lids 16 or tilt forward to the position shown and retain the lids closed.

Figure 2:
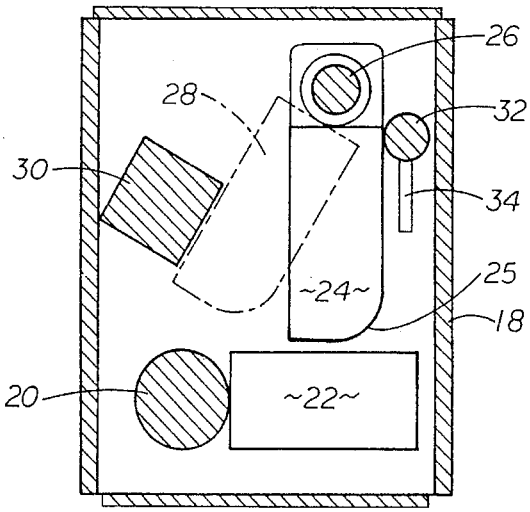
FIG. 2 is a side view of the internal locking assembly.

Within the box 18 is a mechanism as shown in FIG. 2 which automatically retains the bar 14 over the lids 16 when the container 10 is resting right-side up. When the container is lifted up and tilted over an unloading truck the mechanism in the box 18 automatically releases the shaft 20 allowing the bar 14 to tilt backward and release the lids 16.

In FIG. 2 the box 18 is shown with the shaft 20 passing therethrough. Within the box 18 is a turn stop 22 comprising a short steel bar welded to the shaft 20. Above the turn stop 22 is a gravity stop 24 comprising a short steel bar rotatably mounted on an internal shaft 26 entirely within the box 18. With the container 10 in the upright position, the box 18 is in the position shown in FIG. 2 and the gravity stop 24 naturally hangs downward as shown to prevent the turn stop 22 from rotating upward and the shaft 20 from rotating.

When the container 10 is lifted and tilted, the tilting of the container 10 causes the gravity stop 24 to rotate to the position shown in ghosted outline at 28. An internal stop 30 is welded inside the box 18 to prevent the gravity stop 24 from rotating beyond the position 28 shown. The rotation of the gravity stop 24 allows the turn stop 22 and shaft 20 limited rotation which in turn allows the bar 14 to tilt backward and release the lids 16 as the container is tilted over the truck.

The gravity stop 24 is formed with a rounded nose 25 for contact with the turn stop 22. The rounding of the nose 25 and the position of the internal stop 30 determine and limit the amount of rotation of the shaft 20 and in turn the amount the bar 14 tilts backward to clear the lids 16 for opening. Thus, the internal stop 30 limits the backward tilt of the bar 14 only to an amount necessary to generously clear the lids 16 to open.

For manually opening the lids 16 when the container 10 is right side up a manual override assembly is provided comprising a rotatable shaft 32 passing through the box 18 with a steel tab 34 welded to the shaft 32 inside the box 18. By rotating the override shaft 32 clockwise from outside the box 18, the steel tab 34 causes the gravity stop 24 to be rotated to the position 28 thus freeing the turn stop 22 and shaft 20 to rotate and the bar 14 to be manually tilted backward.

As shown in FIG. 1 the override shaft 32 extends from the box 18 and has a lever arm 36 welded at the shaft end. The lever arm 36 extends downward by a small fixed tab 38 welded to the backing plate 23 of the box 18. The fixed tab 38 and lever arm 36 have holes 40 formed therethrough that align when the lever arm 36 is in the inactivated position shown in FIG. 1. Thus, a padlock or other similar means can be used to secure the override lever arm 36 and prevent the bar 14 from being tilted backwards to clear the lids 16.

Figure 3:
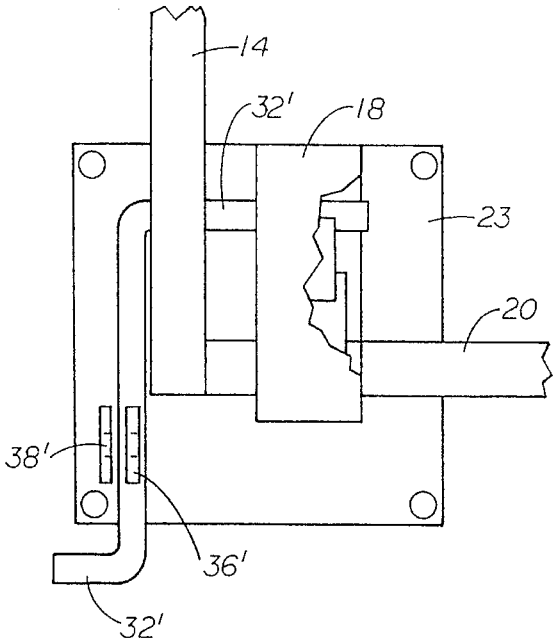
FIG. 3 is a front view of an alternate form of the outside override latch.
Figure 4:
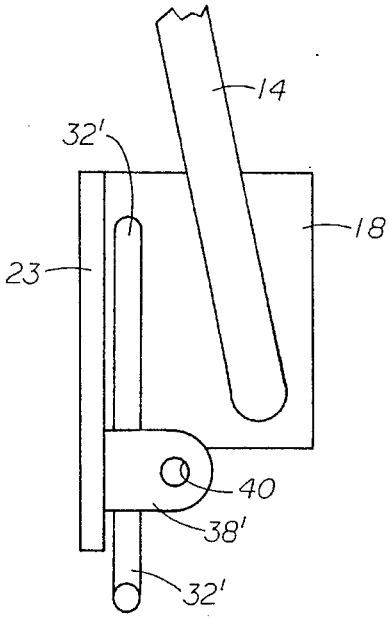
FIG. 4 is an end view of the outside override latch of FIG. 3.

FIGS. 3 and 4 illustrate a modified form of the override assembly wherein the override shaft and lever arm comprise a single crank arm 32' having a second tab 36' welded to the crank arm. A fixed tab 38' is welded to the backing plate 23 of the box 18 and both tabs 36' and 38' have holes 40 formed therethrough that are in alignment when the override crank arm 32' is inactivated. Internally, the box 18 mechanism is as shown in FIG. 2.

Figure 5:
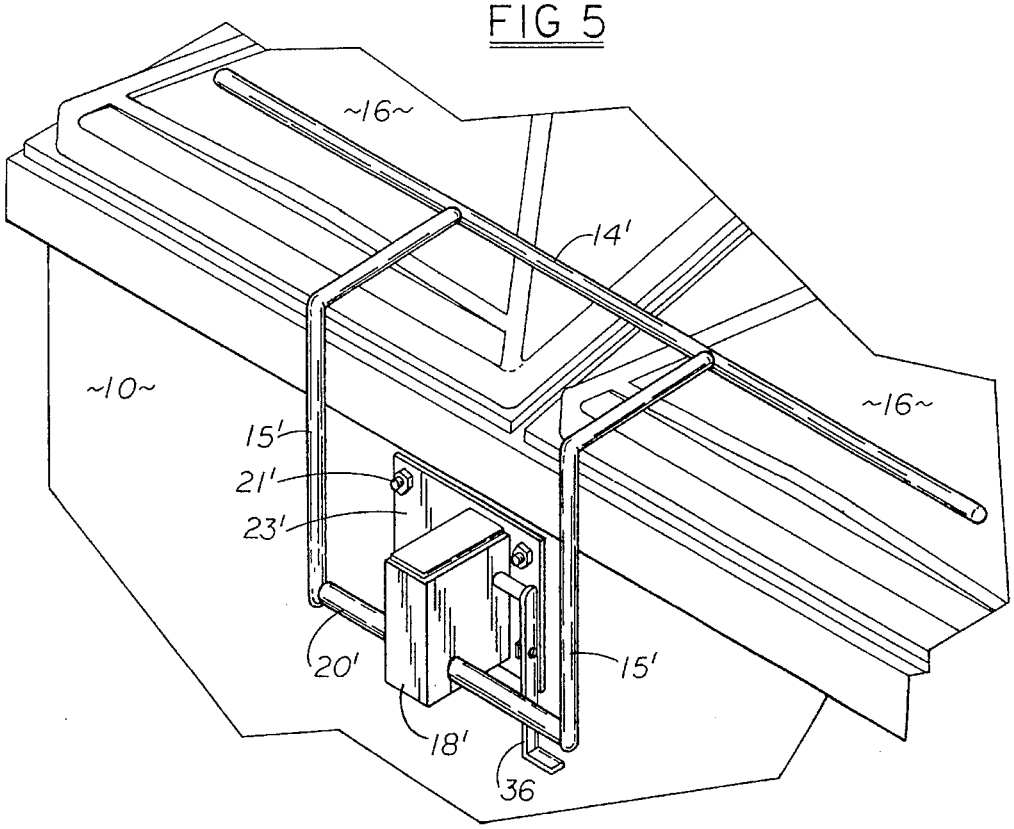
FIG. 5 is a partial perspective view of an alternate form of the lid-locking device.

In FIG. 5 an alternate form of the lid-locking device is illustrated. The retention bar 14' is supported over the lids 16 by a pair of generally vertical arms 15' welded to the bar. The lower ends of the pair of arms 15' are welded to the ends of a shaft 20' with the center of the shaft 20' extending through the security box 18'. The security box 18' is welded to a backing plate 23' in turn bolted at 21' to the front wall of the trash container 10'. The mechanism inside the security box 18' remains the same as disclosed above and either form of the outside override latch 36 disclosed above may be used. This version of the lid-locking device eliminates the bracket, substantially shortens the shaft 20' and is less expensive to manufacture than the version in FIG. 1.

Figure 6:
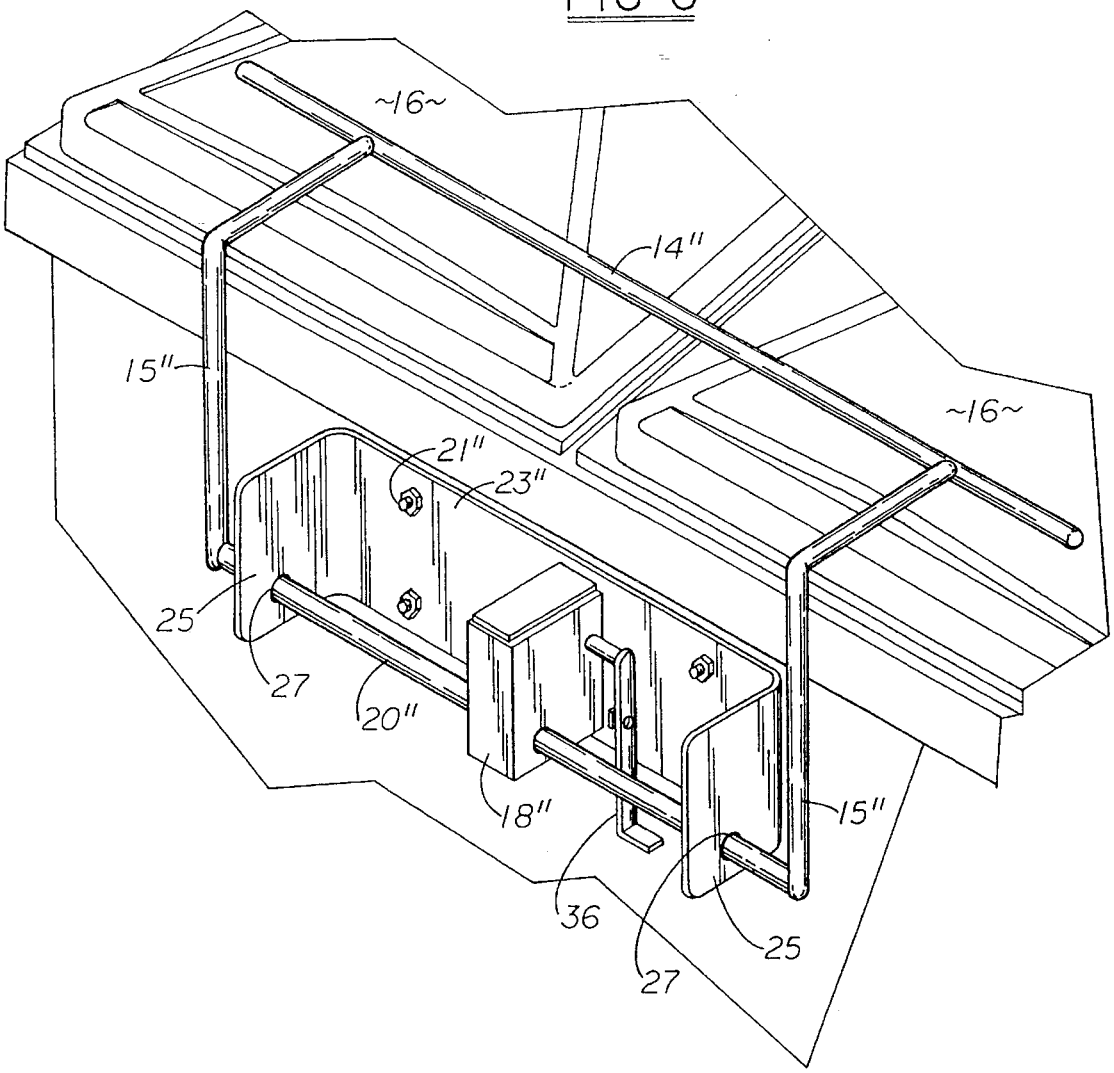
FIG. 6 is a partial perspective view of a second alternate form of the lid-locking device.

In FIG. 6 a second alternate form of the lid-locking device is illustrated. As above the retention bar 14" is supported over the lids 16 by a pair of generally vertical arms 15" welded to the bar. The lower ends of the pair of arms 15" are welded to the ends of a shaft 20" with the center of the shaft 20" extending through the security box 18'. The security box 18' is welded to a backing plate 23" having a shallow U-shape. The base of the backing plate 23" is bolted at 21" to the front wall of the trash container 10'. Each leg 25 of the U-shape backing plate 23" extends beyond the shaft 20". The shaft 20" passes through holes 27 in each leg 25 to provide support immediately adjacent each arm 15" regardless of the distance of the arms 15" from the security box 18'.

I claim:

1. A trash container automatic lid-locking device comprising a rotatable shaft, a bar attached to the rotatable shaft and extending over at least one lid of a trash container when the rotatable shaft is mounted on the front of a trash container, a box mountable on the front of a trash container and having the rotatable shaft passing therethrough, a turn stop attached to the rotatable shaft and located within the box, a gravity lock rotatably attached within the box so as to naturally hang vertically above the turn stop when the box and trash container are right side up, whereby the turn stop and rotatable shaft are substantially prevented from rotating toward the gravity lock, and said gravity lock being rotatable to a position sufficient to allow the turn stop and rotatable shaft to turn in response to tilting of the trash container and a stop to limit the rotational movement of the gravity lock and thereby limit the rotational movement of the rotatable shaft and bar.

2. The trash container automatic lid-locking device of claim 1 wherein the box is attached to a backing plate, said backing plate formed with ends thereof extending perpendicular to a middle portion of the backing plate to form legs, and a hole in each leg, said rotatable shaft extending through the hole in each leg.

3. The trash container automatic lid-locking device of claim 1 including a rounded nose on the gravity lock for engagement with the turn stop.

4. The trash container automatic lid-locking device of claim 1 including a second rotatable shaft passing through the box, a tab attached to the second rotatable shaft within the box, and means externally attached to the second shaft to manually rotate the second shaft whereby manual rotation of the second shaft causes the tab to engage and rotate the gravity lock thereby freeing the rotatable shaft and bar for manual rotation.

5. The trash container automatic lid-locking device of claim 4 wherein the means externally attached to the second shaft include means to lock the second shaft from rotating.

6. The trash container automatic lid-locking device of claim 1 including a second shaft rotatably passing through the box, said second shaft formed into a crank end externally of the box, and a tab attached to the second rotatable shaft within the box, whereby manual rotation of the crank end causes the tab to engage and rotate the gravity lock thereby freeing the rotatable shaft and bar for manual rotation.

7. The trash container automatic lid-locking device of claim 6 including locking means on the crank end and non-moveable complementary locking means affixed adjacent the crank end locking means.

8. The trash container automatic lid-locking device of claim 1 wherein a pair of arms attach the bar to the rotatable shaft, said arms being attached to the bar intermediate the ends of the bar.

9. A trash container having at least one lid hingedly attached thereto, a lid-locking device affixed to the front of the trash container and comprising a security box, a rotatable shaft passing through the box, a bar attached to the rotatable shaft and adapted to extend over and tilt away from the lid with rotation of the rotatable shaft, a turn stop attached to the rotatable shaft and located within the box, a gravity lock rotatably attached within the box so as to naturally hang vertically above the turn stop when the box and trash container are right side up whereby the turn stop and rotatable shaft are substantially prevented from rotating toward the gravity lock, and said gravity lock being rotatable to a position sufficient to allow the turn stop and rotatable shaft to turn in response to tilting of the trash container and a stop to limit the rotational movement of the gravity lock and thereby limit the rotational movement of the rotatable shaft and bar.

10. The trash container of claim 9 wherein a pair of arms attach the bar to the rotatable shaft, said arms being attached to the bar intermediate the ends of the bar.

11. The trash container of claim 10 wherein the security box is attached to the front center of the trash container.

12. The trash container of claim 9 including a rounded nose on the gravity lock for engagement with the turn stop.

13. The trash container of claim 10 including a second rotatable shaft passing through the box, a tab attached to the second rotatable shaft within the box, and means externally attached to the second shaft to manually rotate the second shaft thereby causing the tab to engage and rotate the gravity lock and free the rotatable shaft and bar for manual rotation.

14. The trash container of claim 13 wherein the means externally attached to the second shaft include means to lock the second shaft from rotating.

15. The trash container of claim 10 including a second shaft rotatably passing through the box, said second shaft formed into a crank end externally of the box, and a tab attached to the second rotatable shaft within the box whereby manual rotation of the crank end causes the tab to engage and rotate the gravity lock thereby freeing the rotatable shaft and bar for manual rotation.

16. The trash container of claim 15 including locking means on the crank end and non-moveable complementary locking means affixed adjacent the crank end locking means.

17. The trash container of claim 9 wherein the security box is attached to the front by a backing plate, said backing plate formed with ends thereof extending perpendicular to the front to form legs, and a hole in each leg, said rotatable shaft extending through the hole in each leg.

* * * * *